US007185887B2

(12) United States Patent
Chung

(10) Patent No.: US 7,185,887 B2
(45) Date of Patent: Mar. 6, 2007

(54) APPARATUS FOR SWITCHING PAPER FEED DIRECTION OF IMAGE FORMING DEVICE

(75) Inventor: Kyung-shig Chung, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 173 days.

(21) Appl. No.: 10/606,934

(22) Filed: Jun. 27, 2003

(65) Prior Publication Data

US 2004/0076457 A1 Apr. 22, 2004

(30) Foreign Application Priority Data

Jun. 29, 2002 (KR) ..... 2002-37458

(51) Int. Cl.
*B65H 39/10* (2006.01)

(52) U.S. Cl. ..... 271/303

(58) Field of Classification Search ..... 271/303, 271/184; 399/401, 16, 402
See application file for complete search history.

(56) References Cited

U.S. PATENT DOCUMENTS 5,028,046 A * 7/1991 Kuwahara ..... 271/301
5,953,575 A * 9/1999 Park et al. ..... 399/401

FOREIGN PATENT DOCUMENTS

JP 63-66033 * 3/1988
JP 4-327459 * 11/1992

* cited by examiner

*Primary Examiner*—Patrick Mackey
*Assistant Examiner*—Thomas Morrison
(74) *Attorney, Agent, or Firm*—Staas & Halsey LLP

(57) ABSTRACT

An apparatus to switch a paper feed direction for an image forming device includes a paper guide part disposed across a paper feed path to move from an initial position to a paper passing position or a paper jam removing position by a force generated by passing of the paper, or external power; a supporting part to rotatably fix the paper guide part to a frame of the office machine; an elastic restoring part to restore the paper guide part from the paper jam removing position to the paper passing position; and a restoring force blocking part to block a force of the elastic restoring part from acting on the paper guide part until the paper guide part fixed to the supporting part rotates beyond the paper passing position. The apparatus blocks a force of the elastic restoring part from acting on the paper guide part until the paper guide part is rotated beyond the paper passing position, thereby reducing resistance against the paper and consequently preventing the paper from being blocked due to curling and jamming.

16 Claims, 4 Drawing Sheets

APPARATUS FOR SWITCHING PAPER FEED DIRECTION OF IMAGE FORMING DEVICE

CROSS-REFERENCE TO RELATED APPLICATIONS

This application claims the priority of Korean Patent Application No. 2002-37458, filed Jun. 29, 2002 in the Korean Intellectual Property Office, the disclosure of which is incorporated herein by reference.

BACKGROUND OF THE INVENTION

1. Field of the Invention

The present invention relates to an image forming device, i.e., an office machine such as a laser printer or a copy machine, and more particularly, to an apparatus to switch a paper feed direction of an office machine capable of reducing a resistance against a paper while feeding the paper to prevent the paper from being blocked due to jamming or curling.

2. Description of the Related Art

Generally, an image forming apparatus for duplex (double-sided) printing, for example, a duplex printing laser printer 1 shown in FIG. 1 includes a paper feeding cassette 10 to stack papers, a pickup roller 20 disposed at an upper portion of the feeding cassette 10 to pick up a paper P, a paper feeding guide 22 forming a paper feeding path A to guide the paper P picked up by the pickup roller 20, and a developing unit 30 to form a toner image on a side of the paper P fed through the paper feeding guide 22. The laser printer 1 also includes a fixing unit 40, 41 to fix the toner image formed on the side of the paper P which has passed through the developing unit 30, a feeding roller 50 to feed the paper P which has passed through the fixing unit 40, 41, and a paper discharging roller 60 disposed at an upper side of the feeding roller 50 to discharge the paper P. The laser printer 1 further includes a paper duplex guide 62 forming a paper re-feed path B to re-feed the paper P discharged through the paper discharging roller 60 in order to print the other side of the paper P in a duplex printing mode, and first and second duplex rollers 70, 90 to re-feed the paper P through the paper duplex guide 62.

The developing unit 30 includes a photoconductive drum 32 to form an electrostatic latent image by receiving a light signal such as a laser beam from an LSU (Laser Scanning Unit) 36 and a developing roller (not shown) to develop a toner image by attaching toner onto the electrostatic latent image formed on the photoconductive drum 32.

The photoconductive drum 32 of the developing unit 30 is provided at a lower portion with a transfer roller 34 to transfer the toner image formed on the photoconductive drum 32 onto the paper P.

The fixing unit 40, 41 has a fixing roller 40 and a heating roller 41 to fix the toner image transferred onto the paper P by applying heat and pressure.

A paper feed direction switching apparatus 42 is disposed in the vicinity of the paper discharging roller 60 to be elastically hinged between the paper feeding guide 22 and the paper duplex guide 62 to guide the paper P to the paper duplex guide 62 in the duplex printing mode.

As shown in FIGS. 2 and 3, the paper feed direction switching apparatus 42 includes a long shaft 44, a plurality of paper guide ribs 43 disposed at the shaft 44 at predetermined intervals across a paper feed direction to guide the paper P, an elastic spring 45 with one end 45*a* supported by a frame 47 (see FIG. 3) and another end 45*b* supported by a supporting hole 48*a* of a spring supporting part 48 formed at the shaft 44 to elastically restore the paper guide ribs 43 to an original position after the paper P passes through the paper guide ribs 43 while pushing the paper guide ribs 43, and a lever 46 disposed at one end 44*a* of the shaft 44 to remove a jammed paper P.

In order to sense that the paper P has passed, a sensor actuator 49 is disposed at another end 44*b* of the shaft 44 to move in association with the shaft 44 rotating when the paper guide ribs 43 fixed to the shaft 44 are pushed by the paper P. Also, a paper sensor 49*a* is disposed at a corresponding portion of the frame 47. The paper sensor 49*a* may be an optical sensor, and has a light emitting part and a light receiving part.

A duplex printing process of the laser printer 1 with the above construction will be described hereinafter. First, one of the papers P stacked at the paper feeding cassette 10 is picked up by the pickup roller 20 and then moved to the developing unit 30 through the paper feeding guide 22.

An electrostatic latent image is formed on the photoconductive drum 32 of the developing unit 30 by a laser beam emitted from the LSU 36. The laser beam corresponds to an image signal, and a toner is attached to the electrostatic latent image formed on the photoconductive drum 32 by the developing roller to be developed to a toner image which can be seen.

The toner image formed on the photoconductive drum 32 is transferred on to one side, for example, a top side of the paper P by the transfer roller 34 when the paper P is fed to the developing unit 30 through the paper feeding guide 22. The toner image transferred to the top side of the paper P is fixed thereon by the heating roller 41 and the fixing roller 40 included in the fixing unit.

The paper P which has passed through the heating roller 41 and the fixing roller 40 is fed to the paper discharging roller 60 by the feeding roller 50.

At this point, the paper P pushes the paper guide ribs 43 of the paper feed direction switching apparatus 42 from a position illustrated with a solid line to a position illustrated with a dotted line in FIGS. 1 and 3 by a rotational power of the feeding roller 50, while passing through the paper guide ribs 43. Thereafter, the sensor actuator 49 is separated from the paper sensor 49*a* and the paper sensor 49*a* senses that the paper P has passed.

In a simplex (single-sided) printing mode, the paper P is discharged to a paper tray 59 through the discharging roller 60.

However, in the duplex printing mode, the discharging roller 60 is driven to rotate backward by a separate forward/backward rotation driving controller (not shown) in correspondence with a signal generated at the paper sensor after a rear edge of the paper P is passed through the paper guide ribs 43. Thereafter, the paper P is fed to the paper duplex guide 62 without being discharged to the outside. At this point, since the paper guide ribs 43 are restored elastically to the position illustrated with the solid line in FIGS. 1 and 3, the paper P may be easily fed to the paper duplex guide 62 by the paper guide ribs 43.

The paper, which has reached the paper duplex guide 62, is fed to an arranging roller 80 by the first duplex roller 70. The arranging roller 80 is disposed to be sloped at an angle of about 5 degrees so that a leading edge of the paper P is pushed and arranged by the arranging roller 80.

The paper P arranged by the arranging roller 80 is passed through the second duplex roller 90 back to the paper feeding guide 22, and another side, that is, a bottom side of the paper P is printed on as described before, whereby the paper P is discharged to the paper tray 59.

According to the conventional laser printer 1, since the paper guide ribs 43, which guide the paper P printed on the one side thereof to a paper duplex path B, block a paper feeding path A by the elastic spring 45, the paper P encounters great resistance from an elastic force of the elastic spring 45, a weight of the paper guide ribs 43, etc., when the paper P passes through the paper feeding path A.

When the paper P encounters resistance, the paper P cannot move smoothly but is blocked due to curling and jamming, thereby degrading reliability of the printing.

SUMMARY OF THE INVENTION

Accordingly, it is an aspect of the present invention to solve at least the above problems and/or disadvantages and to provide at least the advantages described hereinafter.

Another aspect of the present invention is to solve the foregoing problems by providing an apparatus to switch a paper feed direction of an office machine capable of reducing a resistance against a paper while feeding the paper to prevent the paper from being blocked due to jamming or curling.

Additional aspects and advantages of the invention will be set forth in part in the description which follows and, in part, will be obvious from the description, or may be learned by practice of the invention Additional aspects and/or other advantages are realized by providing an apparatus to switch a paper feed direction of an image forming device having a frame, the apparatus including a paper feeding path of the paper; a paper guide part disposed across the paper feeding path to be movable from an initial position to an operation position; a supporting part to rotatably fix the paper guide part to the frame of the office machine; an elastic restoring part to restore the paper guide part from the operation position to the initial position; and a restoring force blocking part to block a force of the elastic restoring part from acting on the paper guide part until the paper guide part fixed to the supporting part rotates beyond a predetermined angle.

The elastic restoring part may include an elastic spring with a first end fixed to the supporting part and a second end fixed to the frame, and the restoring force blocking part includes a movable fixing part to movably support the first end of the elastic spring to move within a predetermined range when the supporting part is rotated.

The movable fixing part may include a supporting groove having a circular arc shape disposed at the supporting part with respect to a center of the supporting part to move the first end of the elastic spring within the predetermined range to prevent the paper guide part from being pushed against the paper until the paper guide part is rotated beyond the predetermined angle.

The apparatus may further include a paper sensor, and a sensor actuator disposed at the supporting part to operate the paper sensor disposed at the frame, the paper sensor sensing whether the paper has passed through the paper guide part.

The apparatus to switch the paper feed direction may further include a lever to rotate the paper guide part fixed to the supporting part beyond the predetermined angle to remove a paper jam when the paper is blocked or jammed at the paper guide part.

The initial position of the paper guide part may be a position of the paper guide part where the paper guide part is disposed across the paper feeding path to enable the paper to be guided to a paper duplex path of the office machine for a duplex printing, and the operation range of the paper guide part includes a first range where the paper guide part is rotated at the predetermined angle to discharge the paper to an outside of the office machine through the paper feeding path and a second range where the paper guide part is rotated beyond the predetermined angle in order for the lever to remove a paper jam.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
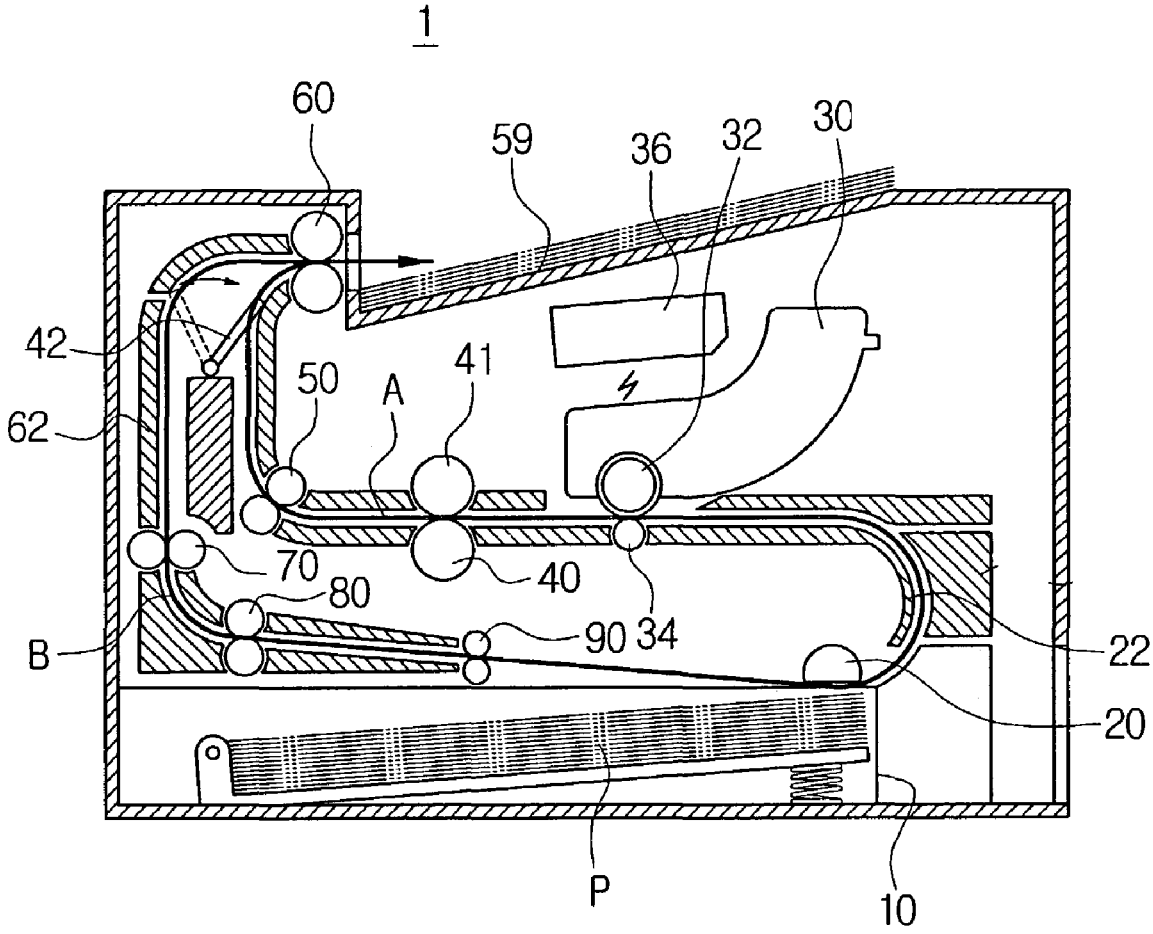
FIG. 1 (PRIOR ART)
FIG. 1 is a cross sectional view of a conventional duplex image forming device.
Figure 2:
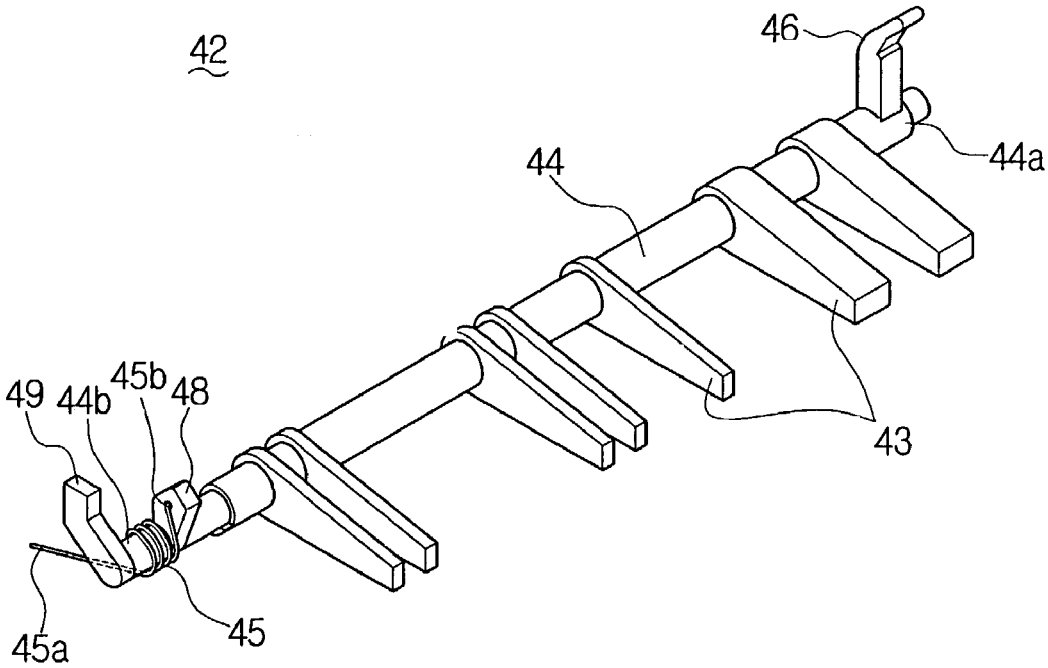
FIG.2 (PRIOR ART)
FIG. 2 is a perspective view of a paper feed direction switching apparatus of the image forming device of FIG. 1.
Figure 3:
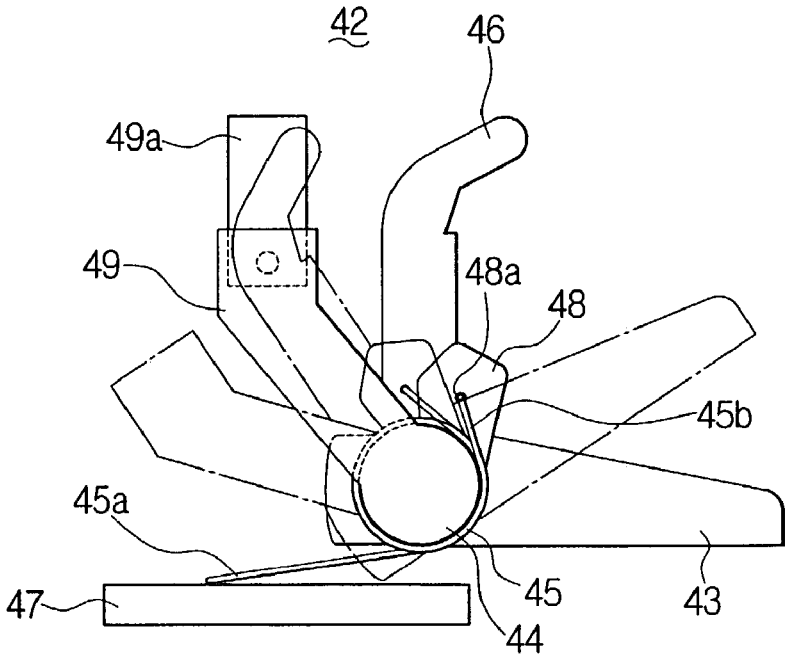
FIG.3 (PRIOR ART)
FIG. 3 is a side view illustrating the operation of the paper feed direction switching apparatus of FIG. 2.

Reference will now be made in detail to the present preferred embodiments of the present invention, examples of which are illustrated in the accompanying drawings, wherein like reference numerals refer to like elements throughout.

An apparatus to switch a paper feed direction according to the embodiment of the present invention will be hereinafter described in detail with reference to the accompanying drawings.

A laser printer having a paper feed direction switching apparatus 100 according to the embodiment of the present invention includes features similar to those shown in FIG. 1, and thus, these elements are not illustrated again. These elements include a paper feeding cassette to stack papers, a pickup roller disposed at an upper portion of the feeding cassette to pick up a paper, a paper feeding guide forming a paper feeding path to guide the paper picked up by the pickup roller, and a developing unit to form a toner image on a side of the paper fed through the paper feeding guide. The present apparatus 100 also includes a fixing unit to fix the toner image formed on the side of the paper which has passed through the developing unit, a feeding roller to feed the paper which has passed through the fixing unit, a paper discharging roller disposed at an upper side of the feeding roller to discharge the paper, and a paper duplex guide to form a paper duplex path to re-feed the paper discharged through the paper discharging roller in order to print another side of the paper in a duplex printing mode, and first and second duplex rollers to re-feed the paper through the paper duplex guide 62.

The paper feed direction switching apparatus 100 is disposed between the paper feeding roller and the paper duplex guide to guide the paper to the paper duplex guide in the duplex printing mode.

Figure 4:
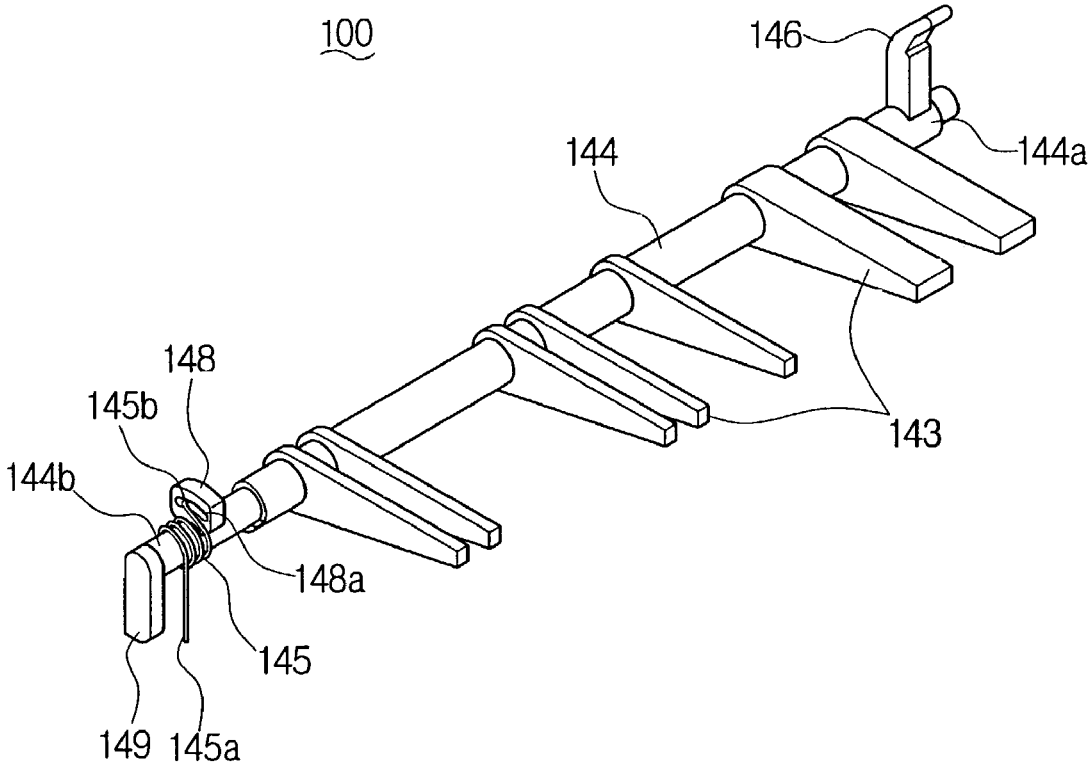
FIG. 4 is a perspective view of a paper feed direction switching apparatus in accordance with an embodiment of the present invention.
Figure 5A:
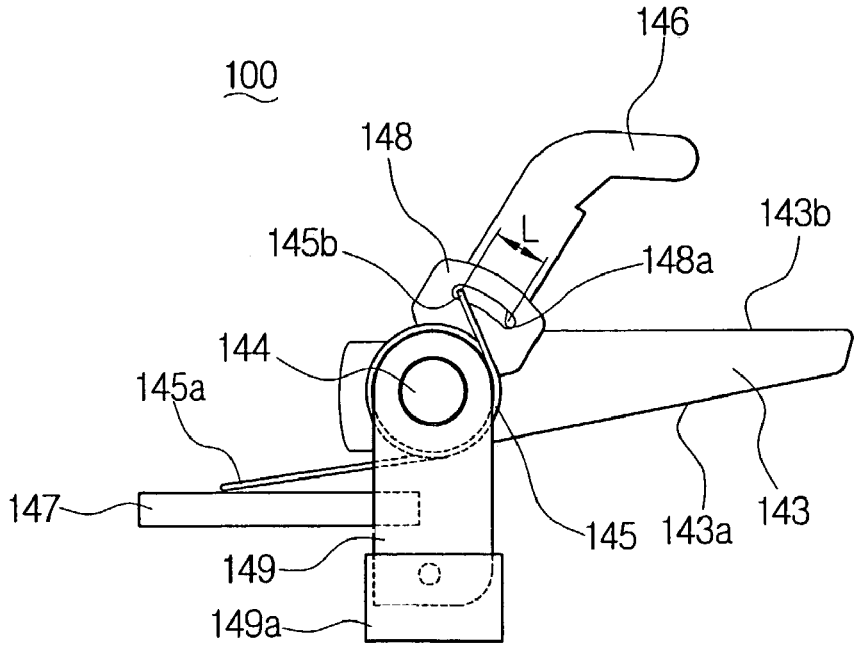
FIGS. 5*a*, 5*b* and 5*c* are side views illustrating the operations of the paper feed direction switching apparatus of FIG. 4.

As shown in FIGS. 4 and 5*a*, the paper feed direction switching apparatus 100 includes a paper guide part 143 disposed across the paper feeding path to move from an initial position (FIG. 5A) to a paper passing position (illustrated with a dotted line in FIG. 5B), or from the initial position to a paper jam removing position (illustrated with a dotted line in FIG. 5C) by a power generated by the passing of paper P or external power. The apparatus 100 also includes a supporting part 144 to rotatably fix the paper guide part 143 to a frame 147 of an image forming apparatus, an elastic restoring part 145 to restore the paper guide part 143 from the paper jam removing position to the paper passing position and a restoring force blocking part 148 to block a force of the elastic restoring part 145 from acting on the paper guide part 143 until the paper guide part 143 fixed to the supporting part 144 rotates beyond a predetermined angle, for example, the paper passing position.

The paper guide part 143 includes a plurality of guide ribs disposed across the paper feeding path at predetermined intervals of a long shaft forming the supporting part 144, to guide the paper P.

Each of the paper guide ribs has a first guide surface 143*a* to guide the paper P toward the paper tray and a second guide surface 143*b* to guide the paper to the paper duplex path in the duplex printing mode.

As shown in FIG. 5A, in the initial position disposed across the paper feeding path, the paper guide part 143 is positioned to be sloped with respect to a surface perpendicular to a paper feed direction in order for the first and second paper guide surfaces 143*a*, 143*b* to easily guide the paper.

The shaft of the supporting part 144 is rotatably supported by a bracket (not shown) of the frame 147 of the duplex laser printer.

The elastic restoring part 145 includes an elastic spring with one end 145*a* supported by the frame 147 and another end 145*b* supported by the restoring force blocking part 148 to elastically restore the paper guide part 143 to the paper passing position, when passing of the paper P is completed or external power is removed after the paper guide part 143 is pushed beyond the paper passing position.

The elastic spring of the elastic restoring part 145 applies an elastic force to the guide part 143 to be restored to the paper passing position, however the paper guide part 143 is restored from the paper passing position to the initial position by the weight thereof, a restoring inertial force and the restoring force blocking part 148, which will be described later.

The restoring force blocking part 148 has a movable fixing part 148*a* to movably support the other end 145*b* of the elastic restoring part 145 within a predetermined angle or a limit of a moving range L when the shaft of the supporting part 144 is rotated by the paper guide part 143.

The movable fixing part 148*a* includes a supporting groove formed as a circular arc with respect to the center of the shaft.

The paper feed direction switching apparatus 100 further includes a sensor actuator 149 fixed at one end 144*b* of the shaft of the supporting part 144 to operate a paper sensor 149*a* disposed at the frame 147 in order to sense whether the paper P has passed when it is moved through the paper feeding path while pushing the paper guide part 143.

Figure 5B:
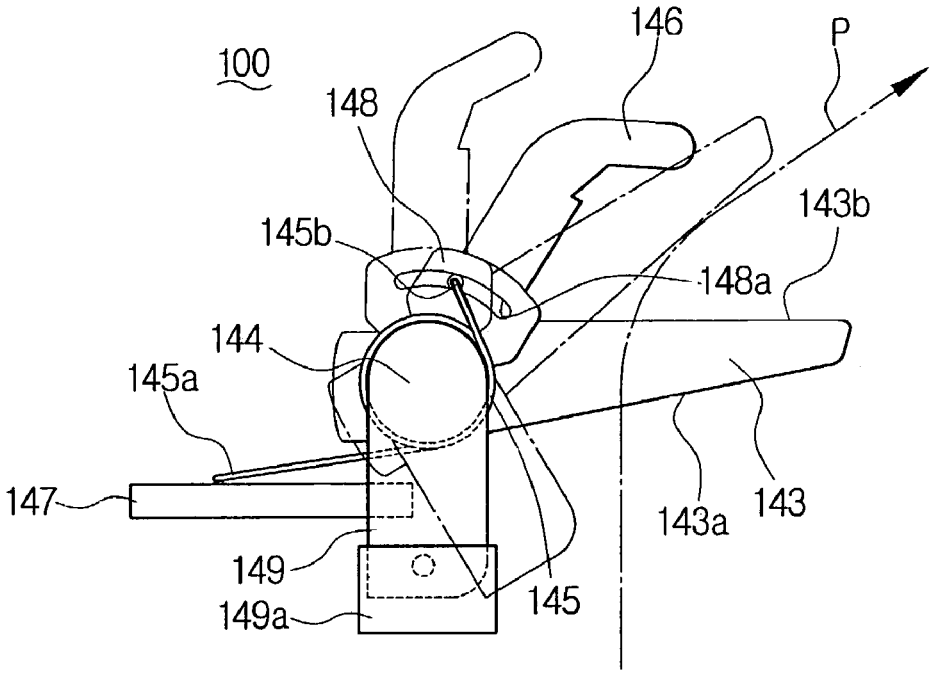

The sensor actuator 149 blocks the paper sensor 149*a* such as an optical sensor including a light emitting part (not shown) and a light receiving part (not shown) to generate an 'off' signal, when the paper guide part 143 is in the initial position, as illustrated with the solid line in FIG. 5B. The sensor activator also moves in association with the shaft of the supporting part 144 and operates the paper sensor 149*a* to generate an 'on' signal when the paper guide part 143 is pushed by the paper P to the paper passing position, which is illustrated with the dotted line in FIG. 5B.

The paper feed direction switching apparatus 100 may further include a lever 146 to rotate the shaft of the supporting part 144 to remove a paper jam when the paper P is blocked or jammed by the paper guide part 143. The lever 146 is disposed at another end 144*a* of the shaft of the supporting part 144.

Figure 5C:
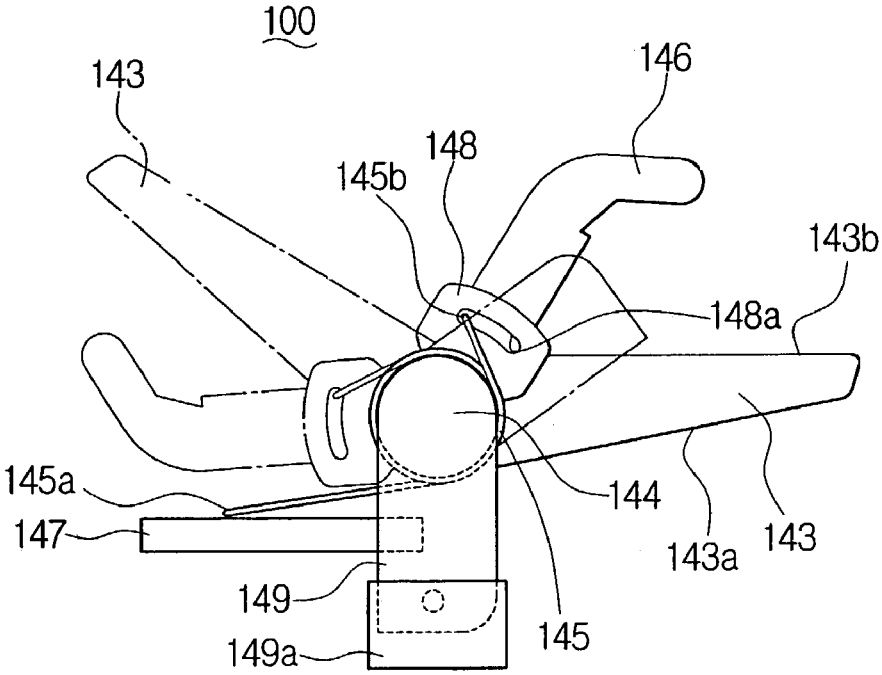

As shown in FIG. 5C, the lever 146 removes the paper jam by moving the paper guide part 143 to between the initial position illustrated with the solid line to the paper jam removing position when the paper is jammed at the paper feeding path or paper duplex path.

With the paper feed direction switching apparatus 100 as described above, even though the paper guide part 143 is rotated by the paper P to the paper passing position, which is illustrated with the dotted line in FIG. 5B when the paper P has passed through the paper feeding path, the elastic force of the elastic restoring part 145 does not act on the paper P due to the movable fixing part 148*a* of the restoring force blocking part 148. Thus, only the weight of the paper guide part 143 acts on the paper P, thereby reducing resistance against the paper P and consequently preventing the paper P from being blocked due to curling and jamming.

Furthermore, when the paper guide part 143 is rotated beyond the paper passing position by the lever 146, that is, to the paper jam removing position, which is illustrated by the dotted line in FIG. 5*c*, the elastic spring 145 applies an elastic restoring force to the paper guide part 143. Therefore, when the external force is removed from the lever 146 after the paper jam is removed, the paper guide part 143 is restored to the paper passing position by the elastic restoring part 145, and then to the initial position by the restoring inertial force and the weight thereof.

Hereinafter, the operation of the paper feed direction switching apparatus 100 will be described in detail.

First, a toner image is formed on one side of the paper P through the developing unit and is fixed thereon through the fixing unit, and then the paper P is fed to the paper feed direction switching apparatus 100 by the rotational power of the feeding roller, whereby the paper guide part 143 is pushed by the paper P to the paper passing position, which is illustrated with the dotted line in FIG. 5B.

Here, the elastic force of the elastic restoring part 145 does not act on the paper P by the circular arc forming a supporting groove (movable fixing part) 148*a* of the restoring force blocking part 148, and thus, only the weight of the paper guide part 143 acts on the paper P, thereby reducing the resistance against the paper P and consequently preventing the paper P from being blocked due to curling and jamming.

As the shaft of the supporting part 144 rotates, the sensor actuator 149 fixed at the one end 144*b* is separated from the paper sensor 149*a*, and thus the paper sensor 149*a* transmits an 'on' signal to a control unit.

As the paper sensor 149*a* transmits the 'on' signal, the control unit operates the paper discharging roller to discharge the paper P toward the paper tray.

Next, when the rear edge of the paper P is passed through the paper guide part 143, the paper guide part 143 pushed by the paper P is restored to the initial position by the weight thereof. As a result, the sensor actuator 149 fixed at the one end 144*b* of the shaft of the supporting part 144 is moved toward the paper sensor 149*a*, and consequently the paper sensor 149*a* transmits an 'off' signal to the control unit.

In the simplex printing mode, the control unit continues to operate the paper discharging roller to discharge the paper P to the paper tray.

On the other hand, in the duplex printing mode, the control unit operates the paper discharging roller to be rotated backward by the separate forward/backward rotation driving controller (not shown) in correspondence with the 'off' signal from the paper sensor 149*a*. Therefore, the paper P is not discharged to the paper tray, but enters into the paper duplex guide.

Here, as the paper guide part 143 is restored to the initial position by the weight thereof, the paper P is guided by the paper guide part 143 to easily enter into the paper duplex guide.

The paper P fed to the paper duplex guide is fed again to the paper feeding guide through the first duplex roller, the arranging roller and the second duplex roller, and then after an image is formed on the other side of the paper P through the printing operation, the paper P is discharged to the paper discharging tray.

As described above, the paper feed direction switching apparatus in accordance with the embodiment of the present invention includes the restoring force blocking part to block the elastic force of the elastic restoring part from acting on the paper guide ribs until the paper guide ribs are rotated beyond the predetermined angle, thereby reducing resistance against a paper and consequently preventing the paper from being blocked due to curling and jamming.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. An apparatus to switch a paper feed direction of a paper for an image forming device having a frame, the apparatus comprising:

a paper feeding path of the paper;

a paper guide part disposed across the paper feeding path to be movable from an initial position to a paper passing position;

a supporting part to rotatably fix the paper guide part to the frame of the image forming device;

an elastic restoring part to restore the paper guide part from the paper passing position to the initial position; and a restoring force blocking part on the supporting part to receive the elastic restoring part, the restoring force blocking part rotating with the paper guide part and the supporting part, the restoring force blocking part comprising a side which is not in contact with the elastic restoring part when the paper guide part has not rotated beyond a predetermined angle relative to the initial position, the side of the restoring force blocking part contacting and elastically deforming the elastic restoring part when the paper guide part rotates past the predetermined angle so that a force of the elastic restoring part acts on the paper guide part via the elastic restoring part and the supporting part only when the paper guide part fixed to the supporting part rotates beyond the predetermined angle.

2. The apparatus according to claim 1, wherein the elastic restoring part includes an elastic spring with a first end supported by the restoring force blocking part and a second end fixed to the frame, and the restoring force blocking part further includes a movable fixing part, the side being defined therein, to movably support the first end of the elastic spring to move within a predetermined range when the supporting part is rotated.

3. The apparatus according to claim 2, wherein the movable fixing part includes a supporting groove, the side being defined therein, having a circular arc shape disposed at the supporting part with respect to a center of the supporting part to move the first end of the elastic spring within the predetermined range to prevent the paper guide part from being pushed against the paper until the paper guide part is rotated beyond the predetermined angle.

4. The apparatus according to claim 3, further comprising:

a paper sensor; and a sensor actuator disposed at the supporting part to operate the paper sensor disposed at the frame, the paper sensor sensing whether the paper has passed through the paper guide part.

5. The apparatus according to claim 1, further comprising a lever to rotate the paper guide part fixed to the supporting part beyond the predetermined angle to remove a paper jam when the paper is blocked or jammed at the paper guide part.

6. The apparatus according to claim 5, wherein the initial position of the paper guide part is a position where the paper guide part is disposed across the paper feeding path to guide the paper to a paper duplex path of the image forming device for a duplex printing, and the paper guide part is moveable between the initial position and a position when the lever rotates the paper guide part beyond the predetermined angle.

7. An apparatus comprising:

a guide to guide a paper at a first position and moveable to a second position to remove the paper during a paper jam;

a restoring unit to urge the guide towards the first position when the guide is at the second position; and a blocking unit to position the restoring unit so that a force of the restoring unit acts on the guide only when the guide rotates beyond a predetermined angle relative to the first position.

8. The apparatus according to claim 7, further comprising:

a developer to develop a first image on a first side of the paper;

a feed roller to feed the paper having the first image to the guide along a first path; and a duplex roller to feed the paper having the first image along a second path after the paper passes the guide, wherein the developer develops a second image on a second side of the paper after being fed along the second path.

9. The apparatus according to claim 7, further comprising a paper feeding path to feed the paper, wherein said first position is a position of the guide before said paper contacts said guide.

10. The apparatus according to claim 9, wherein the guide is moved from the first position to the predetermined angle by a force of the paper, and from the predetermined angle to the second position by an external force.

11. The apparatus according to claim 7, wherein a force of said restoring unit urges the guide to move from the second position to the predetermined angle.

12. The apparatus according to claim 8, wherein the guide comprises a plurality of ribs each having a first side to guide the paper to the second path and a second side to discharge the paper after the second image is developed.

13. The apparatus according to claim 12, wherein the ribs are sloped with respect to a plane that is perpendicular to a feed direction of the paper.

14. The apparatus according to claim 11, wherein the restoring unit allows the guide to move between the first position and the second position when activated by an external force, the external force including a first force moving the guide from the predetermined angle to the second position and a second force moving the guide from the second position to the first position.

15. The apparatus according to claim 11, wherein the guide is moved from the predetermined angle to the first position only by a weight of the guide.

16. An apparatus comprising:

a guide to guide a paper, the paper moving the guide from initial position to a paper passing position while passing therethrough in an unjammed state, and the guide being moved by an external force to a paper jam removing position when the paper is jammed;

a frame;

a supporting part to rotatably fix the guide to the frame; and a restoring unit to urge said guide to move to the paper passing position from the paper jam removing position, the guide moving from the paper passing position to the initial position only by a weight of the guide by rotating relative to the frame according to the supporting part.

* * * * *

UNITED STATES PATENT AND TRADEMARK OFFICE

CERTIFICATE OF CORRECTION

PATENT NO. : 7,185,887 B2
APPLICATION NO. : 10/606934
DATED : March 6, 2007
INVENTOR(S) : Kyung-shig Chung It is certified that error appears in the above-identified patent and that said Letters Patent is hereby corrected as shown below:

Column 9, Line 13, before "initial" insert --an--.

Signed and Sealed this

Twenty-sixth Day of June, 2007

JON W. DUDAS
*Director of the United States Patent and Trademark Office*